United States Patent [19]

Jackson

[11] Patent Number: 4,850,345

[45] Date of Patent: Jul. 25, 1989

[54] PILOT OPERATED VALVES

[76] Inventor: Peter J. Jackson, 3 Queensmead, Franklin Road, Durrington, Worthing, England

[21] Appl. No.: 258,569

[22] Filed: Oct. 18, 1988

Related U.S. Application Data

[63] Continuation of Ser. No. 90,892, Aug. 31, 1987, abandoned.

[30] Foreign Application Priority Data

Sep. 6, 1986 [GB] United Kingdom ..... 8621516

[51] Int. Cl.[4] ..... A02B 7/04

[52] U.S. Cl. ..... 128/202.27; 128/205.24; 137/489; 137/491; 137/492

[58] Field of Search ..... 137/489, 491, 492, 492.5; 128/202.27, 205.24

[56] References Cited

U.S. PATENT DOCUMENTS

| | | | |
|---|---|---|---|
| 843,174 | 2/1907 | Reynolds | 137/489 |
| 2,690,760 | 10/1954 | Hughes | 137/489 X |
| 3,285,261 | 11/1966 | Chaney | 137/491 X |
| 3,388,717 | 6/1968 | Kelly | 137/489 X |
| 3,752,175 | 8/1973 | Hamilton | 137/491 X |
| 3,805,823 | 4/1974 | Kakegawa | 137/489 |
| 4,231,393 | 11/1980 | Byfuglien | 137/491 |
| 4,334,532 | 6/1982 | Jackson | 137/491 X |

*Primary Examiner*—Alan Cohan
*Attorney, Agent, or Firm*—Lon H. Romanski

[57] ABSTRACT

There is disclosed a pilot operated valve which includes a valve body, a main valve having a main valve member controlling fluid communication between an inlet port and an outlet port, a pilot valve including a vent passage sensing downstream pressure to open and close the main valve member as the sensed pressure is above or below a predetermined pressure, and selectively operable override means to suspend pilot operation of the valve. The override means may be means to occlude the vent passage and thus close the main valve, means to open the vent passage to atmosphere and thus open the main valve, or means to bypass the main valve.

7 Claims, 4 Drawing Sheets

Fig. 1
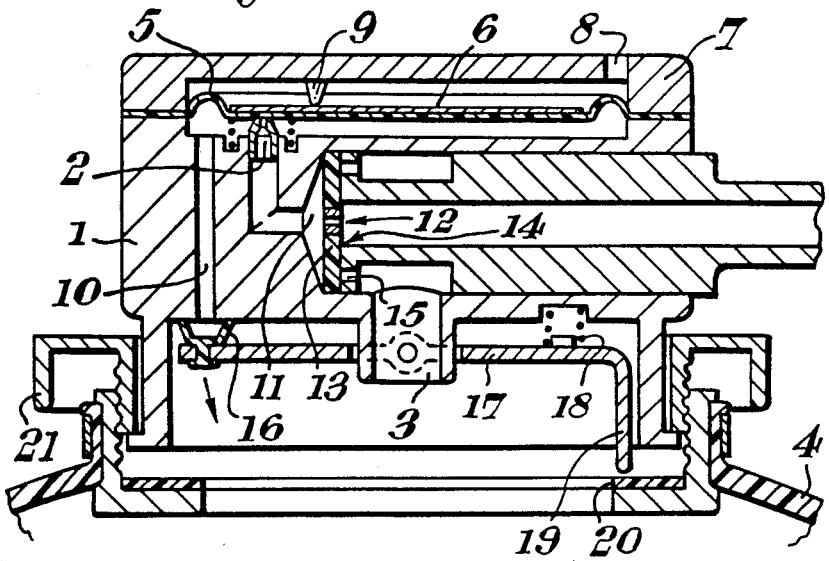
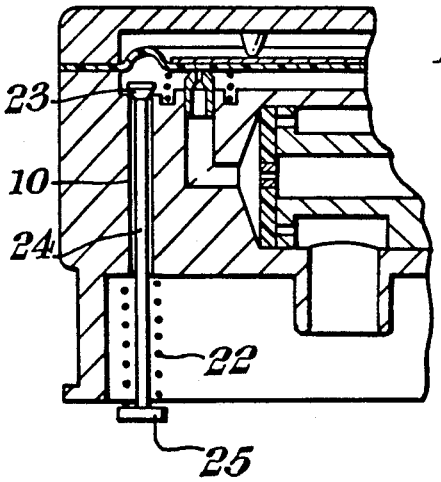
Fig. 2
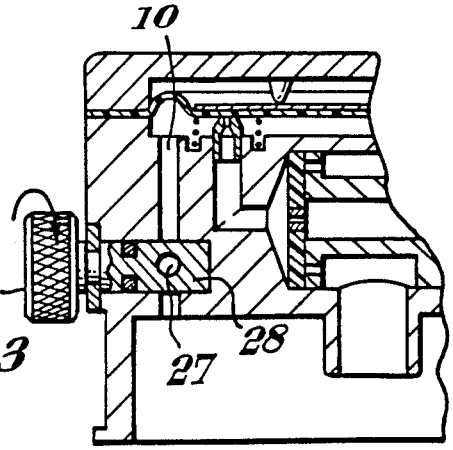
Fig. 3

PILOT OPERATED VALVES

This is a continuation of application Ser. No. 090,892, filed Aug. 31, 1987 now abandoned.

This invention relates to pilot operated valves in general where downstream pressure is sensed and a valve opened or closed in accordance with the sensed pressure. The invention relates particularly to demand valves for breathing apparatus, whereby breathable gas is supplied automatically to the wearer in accordance with his respiratory requirements. A first aspect of the invention is concerned with demand valves of the positive pressure type which continually maintain a pressure within a facepiece or helmet which is slightly greater than that of the surrounding atmosphere, so as to prevent inward leakage.

In such demand valves, flow of gas to the wearer is controlled by movement of a sensitive diaphragm having one face exposed to atmospheric pressure, and the other face to pressure within the facepiece. The present invention provides control means for such valves allowing manual override and automatic shut-off of the supply of gas.

Valves of the Pilot or Two Stage type are sometimes used, wherein mechanical advantage is obtained by gas pressures. Such valves generally employ pivoted levers as a means of transmitting diaphragm movement to the valve, often because the direction of diaphragm movement is inconvenient and has to be reversed.

In known demand valves, the positive pressure is usually established by biassing the diaphragm with a spring.

A first aspect of the present invention concerns a demand valve described in UK Patent Application No. 87.09604, the demand valve comprising a housing defining first and second chambers separated by a diaphragm, the first chamber being vented to atmosphere and including fulcrum means to define an eccentric pivot axis for a rigid central part of the diaphragm, the second chamber including a pilot jet facing the diaphragm and closeable thereby at a position on the side of the pivot axis remote from the centroid of the rigid portion of the diaphragm, and a vent passage having an outlet at the outlet of the demand valve, the housing further defining a third chamber communicating with the pilot jet and partially defined by a valve member adapted to deny access from a high pressure supply port to an outlet port, high pressure being supplied to the third chamber via an orifice, such that while a predetermined back pressure is applied to the outlet of the vent passage, the rigid portion of the diaphragm is held in a position to close the pilot jet and the valve member is held in its closed position by the high pressure supplied to the third chamber via the orifice, and that when the back pressure is reduced the pilot jet is opened, the pressure in the third chamber reduces and the valve member moves to permit access from the supply port to the outlet.

It is advantageous for demand valves of breathing apparatus to be detachable from the facepiece, for procedural and testing purposes. To this end, the invention provides an automatic shut-off of the demand valve when the demand valve is removed from the facepiece.

According to a first aspect of the invention, a pilot operated valve has a housing including an inlet port and an outlet port, and a valve member which selectively allows or prevents fluid communication between the inlet and outlet ports in response to predetermined pressure levels sensed at a vent passage, and further includes means operable selectively to override the pilot operation of the valve by varying the pressure level at the vent passage. The pressure level at the vent passage may be varied either by occluding the vent passage, or by providing fluid communication between the vent passage and the atmosphere. A demand valve for mounting to a facepiece of a breathing apparatus may include an occluding member biassed towards a first position in which it occludes the vent passage, the occluding member including abutment means cooperating with complementary abutment means on the facepiece so that when the demand valve is mounted to the facepiece the occluding member is urged out of its first position and the vent passage communicates with the interior of the facepiece.

As an alternative, a manually operated cut-out control, may be provided in which the vent passage may be selectively either opened to atmosphere or occluded by a manually operated valve.

In yet another embodiment, an occluding arrangement may be provided on which the vent passage is occluded by means sensitive to a reduced downstream pressure and acting to open the vent passage when such a pressure is sensed. In such a device, the vent passage is manually occluded, remaining thus until the commencement of respiration automatically re-opens said passage.

Yet another aspect of the invention provides an override control for a valve including a body having an inlet port and a coplanar outlet port and a valve member overlying both ports in the closed position of the valve and being held away from the ports in the open position of the valve.

An override control for such a valve comprises a tubular member having lateral openings at one end, the tubular member being axially movably received in the inlet port for movement between a first position where the one end of the tubular member is out of contact with the valve member, and a second position wherein the tubular member extends through the inlet port to contact the valve member with its one end, the valve member being urged away from the inlet and outlet ports by the tubular member and fluid communication between the inlet and outlet ports being established via the lumen of the tubular member and the lateral openings.

An alternative override control may be provided by bypassing the valve member via a passageway in the valve body communicating with the valve outlet which may cooperate with a second passageway communicating with the gas supply when two relatively movable parts of the valve are in a registering configuration.

Examples of pilot valves, illustrating each aspect of the invention will now be described in detail with reference to the accompanying drawings, in which:

FIGS. 1, 2 and 3 show a pilot valve embodying the first aspect of the invention, in sectioned elevation in FIG. 1 and in part-section in FIGS. 2 and 3;

Figure 4:
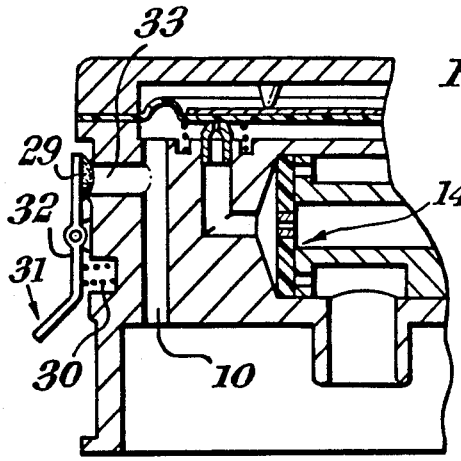
FIG. 4 is a part sectional view similar to FIGS. 2 and 3, showing an alternative override arrangement.

Referring now to FIGS. 1 to 3, there is provided a pilot operated valve, suitable for use as a demand valve, which is of small size and wherein a diaphragm regulates the flow of gas from a small pilot jet which in turn regulates the flow of gas from a larger jet to a facepiece.

The demand valve comprises a housing 1 which incorporates a pilot jet 2 and an outlet port 3 for connection to a facepiece 4. A diaphragm 5 of flexible and resilient material, supported over the greater part of its area by a rigid backing plate 6, is clamped in a leak-tight manner to the housing by a cover 7 secured to the housing 1 by means of screws or a suitable clip arrangement. The cover is vented to atmosphere by one or more ports 8 and bears two internal projections 9 which act as fulcrum points about which the diaphragm 5 can tilt. A vent passage 10 connects the area under the diaphragm to the interior of the facepiece 4, by which means not only is pressure within the facepiece 4 transmitted to the diaphragm 5, but also the small flow of gas from the pilot jet 2 when open is freely allowed to escape to the interior of the facepiece.

Movement of the diaphragm 5 towards or away from the pilot jet 2, in response to pressure changes within the facepiece, regulates the escape of gas from a control pressure chamber 11 respectively raising or lowering the pressure in said chamber. This control pressure results from a small flow of gas into the chamber 11 through a metering orifice 12 in a resilient disc 13. The relative proportions of the metering orifice 12 and the pilot jet 2 are so arranged that when the diaphragm 5 is almost touching the pilot jet 2 there will be sufficient pressure in the control chamber 11 to force the resilient disc 13 against the face of main jet 14, obstructing a plurality of ports 15 in said face such that escape of gas from the main jet 14 to the outlet 3 is prevented.

Movement of the diaphragm away from the pilot jet 2 will cause pressure in the control pressure chamber 11 to fall, such that the resilient disc 13 will bow away from the face of the main jet 14 under the influence of gas supply pressure, whereupon gas can escape through the ports 15 thus uncovered and pass to the facepiece via the outlet port 3.

To provide such a demand valve with an automatic cut-off when it is detached from the facepiece 4, there is provided a closure 16 preferably of resilient material, mounted on a lever 17 and biased by a spring 18 into a position to close the vent passage 10. The lever 17 includes a finger 19 which extends toward an abutment 20 on the facepiece, so that when locking ring 21 is tightened the closure 16 is held away from the vent passage 10, and the diaphragm 5 experiences on its underside the pressure within the facepiece, opening the main valve 13 when the facepiece pressure falls. When the demand valve is removed from facepiece 4, the closure 16 blocks vent passage 10, and the pressure built up beneath the diaphragm closes the pilot jet 2, thus closing the main valve 13 as described.

FIG. 2 shows a part section of a demand valve such as that of FIG. 1, with an alternative arrangement for closing the vent passage 10 when the valve is disconnected from a facepiece 4. Spring 22 urges the head 23 of the rod 24 to close the upper end of vent passage 10 when the heel 25 of the rod is not urged upward by engagement with an abutment such as 20 on the facepiece 4.

FIG. 3 shows a manual cut-off arrangement, in which rotation of a knurled knob 26 closes the vent passage 10 by moving the transverse bore 27 of the shaft 28 out of registry with vent passage 10.

Referring now to FIG. 4, there is shown a valve 29 biased by a spring 30 towards a closed position; opening of the valve by depressing the heel 31 of the lever 32 will cause the vent passage 10 to be opened to atmosphere via the aperture 33. This causes the main valve 14 to open since the pilot diaphragm 5 senses a "loss" of back pressure.

Figure 5:
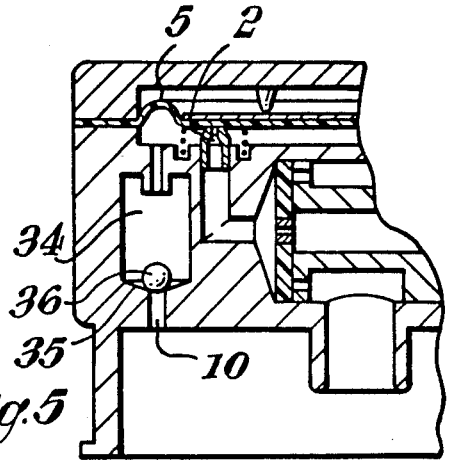
FIG. 5 shows a partial sectional view, illustrating another alternative override arrangement.

In FIG. 5 the vent passage 10 is preceded by a cylindrical chamber 34 having a shallow conical face 35 at its outlet end. A lightweight plastics ball 36 within the chamber is caused, by positioning the valve in an appropriate (e.g. inverted) attitude, to roll into the centre of the cone, in which position it occludes the vent passage 10 whereupon the pressure build up under the diaphragm 5 closes the pilot jet 2 thus closing the main valve 14. The pressure built up under the diaphragm 5, being applied to the ball, clamps the ball in position over the unpressurised vent passage outlet, regardless of subsequent changes in attitude of the valve.

When pressure is applied to the outlet of the vent passage, for example by exhaling into the facepiece, the ball 36 falls away from the centre of the conical face 35 and into the chamber 34, exposing the vent passage 10, thus allowing the diaphragm 5 to respond normally to subsequent pressure changes in the facepiece.

Figure 6:
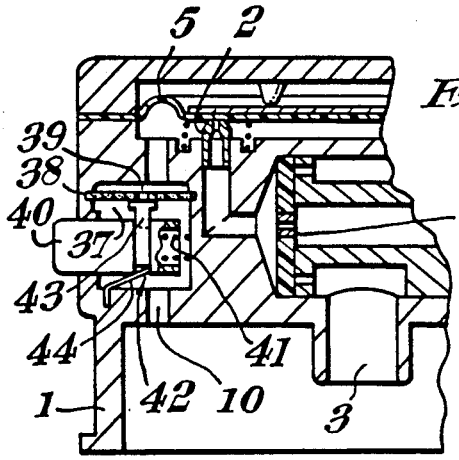
FIGS. 6 and 7 show yet another alternative override arrangement for the pilot valve, with the vent passage occluded and open, respectively.
Figure 7:
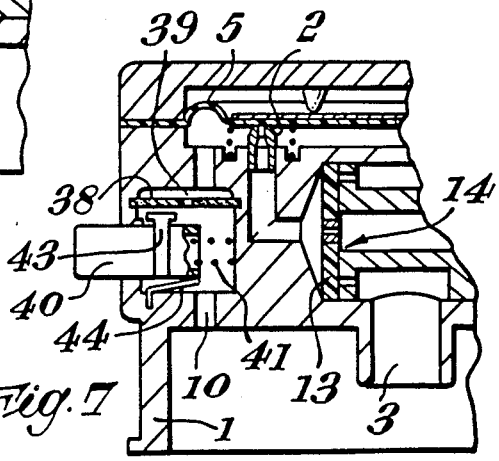

In FIGS. 6 and 7, the vent passage 10 passes through a chamber 37 closed at one end by a small resilient diaphragm 38 in which a port 39 permits communication between the vent passage outlet and the area under the main diaphragm 5. A plunger 40 projecting through the wall of the housing 1 and biased outwards by a spring 41 has a circumferential groove 42 in which a forked saddle 43 is free to slide vertically as seen in FIGS. 6 and 7 up and down. A spring latch 44 engages in the plunger groove 42 when the plunger is pushed into the housing, preventing its outward return.

When thus engaged in the plunger groove 42, the spring latch 44 pushes the saddle 43 upwardly, so that its upper surface touches the diaphragm 38 and occludes the port 39 therein.

Communication between the area under the main diaphragm 5 and the vent passage 10 is thus cut off, and pressure built up under the main diaphragm 5 closes the pilot jet 2 thus closing the main valve 14.

Inhalation creates a marked reduction of pressure within the facepiece, causing the diaphragm 38 to be drawn downwardly, pressing the saddle 43 against the spring latch 44 and disengaging the latter from the groove 42 in the plunger 40. The plunger then moves outwardly under the influence of the spring 41. The saddle 43, being located in the plunger groove 42, moves outwards with the plunger, thus exposing the port 39 in the diaphragm 38 and restoring communication between the vent passage 10 and the area under the main diaphragm 5.

Figure 8:
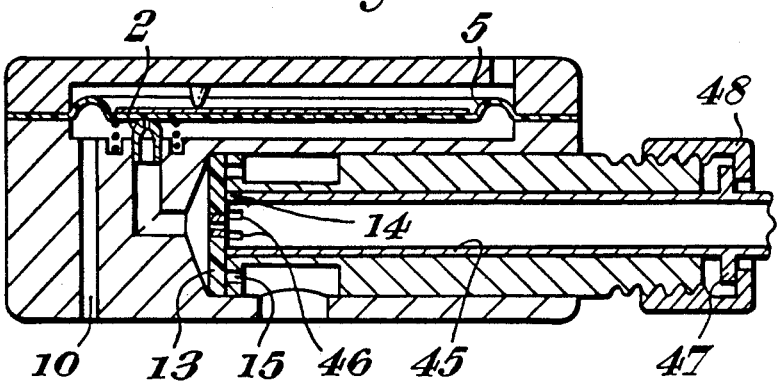
FIGS. 8 and 9 show a pilot operated valve including a first bypass arrangement, respectively in the inoperative and operative positions.
Figure 9:
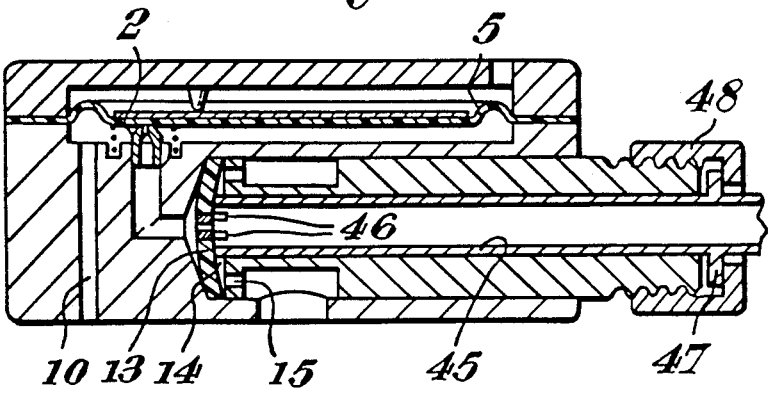
Figure 10:
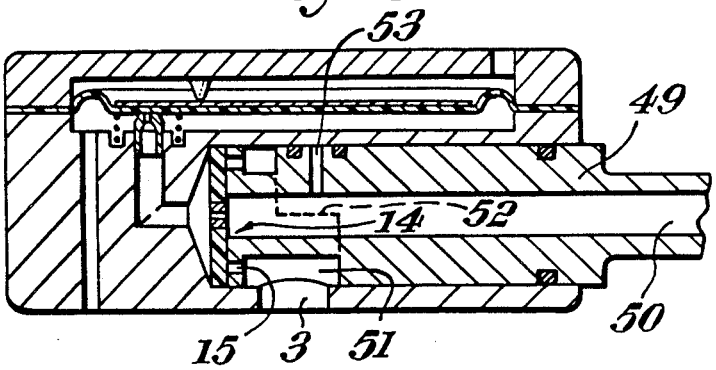
FIGS. 10 and 11 show a pilot operated valve including a second bypass arrangement, respectively in the inoperative and operative positions.
Figure 11:
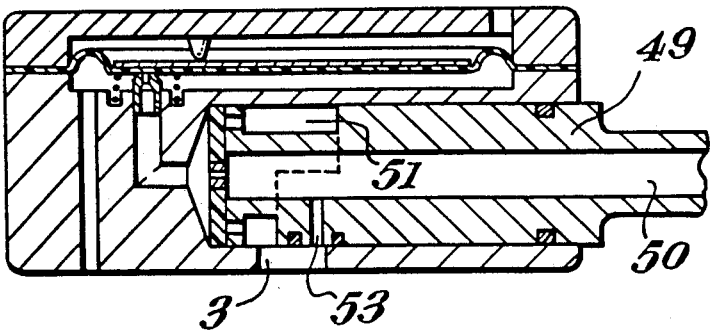

Referring now to FIGS. 8 and 9, the demand valve is shown without its connections to the facepiece, since the override arrangement is not concerned therewith.

In FIG. 8, there is seen a valve member 13 in its closed position wherein it covers inlet port 14 and outlet ports 15 coplanar with port 14.

Within inlet port 14 lies a tubular member 45, having lateral openings 46 at its one end and connected to the supply gas at its other end. As may be seen, a flange 47 on the tubular member abuts a collar 48 threadedly engaging the valve body, to control the axial position of the tubular member 45 relative to the body. In the normal operating position, shown in FIG. 8, the one end of the tubular member 45 lies within the inlet port and the valve operates in its usual pilot controlled fashion. To override the pilot operation, collar 48 is turned to urge flange 47 to advance the tubular member 45 to the position shown in FIG. 9, wherein the end of tubular member 45 abuts and bows the valve member 13 to uncover the outlet ports 15. Gas may then flow from the supply through the tubular member 45, out of the lateral openings 46 and to the outlet ports 15. A preset minimum gas flow rate may be achieved by exposing the openings 46 only partially, depending on the extent to which tubular member 45 protrudes from the inlet port. Should the back pressure at the vent passage 10 drop, then the pilot diaphragm 5 may open pilot jet 2 to increase the gas flow by bowing the valve member 13 further. Restoration of the back pressure at vent passage 10 will cause the valve member 13 to resume its position abutting the one end of tubular member 45, restoring the minimum gas flow rate. Collar 40 may carry indicia to indicate the minimum flow rate for various positions of the tubular member 45.

Referring now to FIGS. 10 to 13, two alternative bypass arrangements to provide an override are shown. A cylindrical member 49 has a central supply passage 50 leading to one of its ends, where the inlet port 14 of the valve is situated. A circumferential groove 51 about the cylindrical member 49 communicates with axial outlet ports 15 extending from the end of cylindrical member 49, and communicates with outlet aperture 3. The circumferential groove 51 is of varying axial extent, being stepped as at 52.

A bypass passage 53 leading radially from the supply passage 50 may be brought into registry with the outlet aperture 3 by rotating the cylindrical member 49, to provide direct fluid communication between the supply and outlet aperture 3. Clearly, when the bypass passage 53 is not in registry with the outlet aperture 3, the normal pilot operation of the valve controls the flow. Control of the bypass flow may be achieved by varying the overlap between the outlet aperture 3 and the bypass passage 53.

Figure 12:
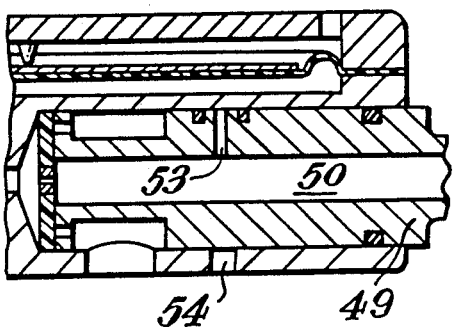
FIGS. 12 and 13 are partial sections of a pilot valve including a third bypass arrangement, respectively in the inoperative and operative positions.
Figure 13:
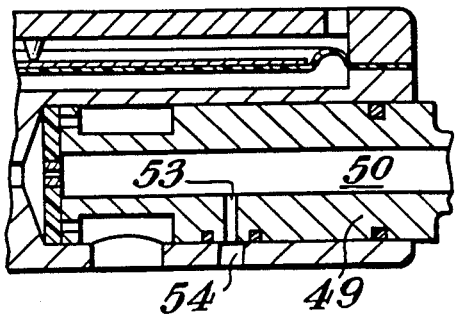

A similar arrangement is shown in FIGS. 12 and 13 in the closed and open positions of the bypass respectively. In this arrangement a separate bypass outlet 54 is provided to be in registry with bypass passage 53 in the open position.

It should be understood that although the various embodiments described concern demand valves for breathing apparatus, it is possible to control any type of valve having a pilot vent passage by selective opening or closing of the vent passage to vary the sensed controlling pressure. The invention is thus applicable to pilot operated valves in general, and is not restricted to the exemplary configurations shown.

What is claimed is:

1. A breathing apparatus, comprising a facepiece and a demand valve wherein the demand valve is a pilot operated valve having a housing including an inlet port for connection to a source of pressurized gas, an outlet port to discharge gas, and a valve member which selectively allows or prevents fluid communication between the inlet and outlet ports in response to a predetermined pressure level sensed at a vent passage, the demand valve further including an occluding means operable to occlude the vent passage and thus override the pilot operation of the valve, the occluding means being carried by the housing for movement between first and second positions in which the vent passage is respectively open and occluded, and cooperating engagement means being provided on the occluding means and on the facepiece so that when the demand valve is mounted to the facepiece the occluding means occupies said first position.

2. A breathing apparatus according to claim 1 wherein the occluding means is resiliently biased toward said second position.

3. A breathing apparatus according to claim 1 wherein the occluding means comprises a lever pivotally mounted to the housing, the lever having a first end adapted to engage the facepiece when the demand valve is mounted thereto, and a second end adapted to selectively occlude the vent passage.

4. A breathing apparatus according to claim 3 wherein the occluding means is resiliently biased toward said second position.

5. A breathing apparatus according to claim 1 wherein the occluding means comprises an elongate stem having two axial end portions, the stem being mounted to the housing for axial movement between said first and second positions, one axial end portion of said stem engaging the facepiece when the demand valve is mounted thereto and the other axial end portion of the stem being adapted to occlude the vent passage.

6. A breathing apparatus according to claim 5 wherein the occluding means is resiliently biased toward said second position.

7. A breathing apparatus according to claim 5 wherein said stem is received by and extends through said vent passage.

* * * * *